United States Patent [19]

Klein

[11] 4,047,661

[45] Sept. 13, 1977

[54] PRINT ENVELOPE

[75] Inventor: Bernard Klein, Kearney, Mo.

[73] Assignee: Tension Envelope Corporation, Kansas City, Mo.

[21] Appl. No.: 667,506

[22] Filed: Mar. 17, 1976

[51] Int. Cl.[2] ..... B65D 27/08

[52] U.S. Cl. ..... 229/70; 229/72

[58] Field of Search ..... 229/70, 72, 56, 68 R; 206/455

[56] References Cited

U.S. PATENT DOCUMENTS

| | | | |
|---|---|---|---|
| 117,795 | 8/1871 | McMahan | 229/72 |
| 332,454 | 12/1885 | Smith | 229/70 |
| 1,177,886 | 4/1916 | Newcomb | 229/70 X |
| 1,976,321 | 10/1934 | Benedict | 229/72 |
| 2,887,327 | 5/1959 | Tucker | 229/72 X |
| 3,299,928 | 1/1967 | Inkley | 229/72 X |
| 3,302,861 | 2/1967 | Hiersteiner | 229/70 |

*Primary Examiner*—Stephen P. Garbe
*Attorney, Agent, or Firm*—Fishburn, Gold & Litman

[57] ABSTRACT

An envelope for containing photographic prints and negatives in separate pockets comprising substantially rectangular front and back panels interconnected along three edges thereof forming a first pocket particularly adapted for containing photographic prints, and having an insert opening between the remaining edges of the panels. A center flap is connected to the remaining edge of the back panel along a fold line, and overlies a portion of the back panel. A patch member has a lower edge and at least one side edge thereof attached to the center flap forming a second pocket particularly adapted for containing photographic negatives, and having an insert opening along the two remaining edges of the patch. A closure flap is connected to the remaining edge of the front panel along a fold line and overlies the patch member when in a closed position.

11 Claims, 4 Drawing Figures

PRINT ENVELOPE

This invention relates to protective storage envelopes and in particular to envelopes for containing photographic prints and negatives in separate pockets.

The principal objects of the present invention are: to provide a two-compartment envelope including a center flap and a patch member attached thereto along a lower edge thereof and at least one side edge forming a second separate pocket for the safe and convenient storage of photographic negatives therein; to provide such an envelope wherein the patch member is substantially transparent such that the contents of the second pocket are readily visible; to provide such an envelope wherein the flap is easily detachable from the back panel along a perforated tear line; to provide such an envelope wherein outer portions of the center and closure flaps are divided along perforated tear lines into removable coupons; to provide such an envelope wherein an index tab adapted for grasping, provides easy access to the second pocket; and to provide such an envelope which is economical to manufacture, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

Figure 1:
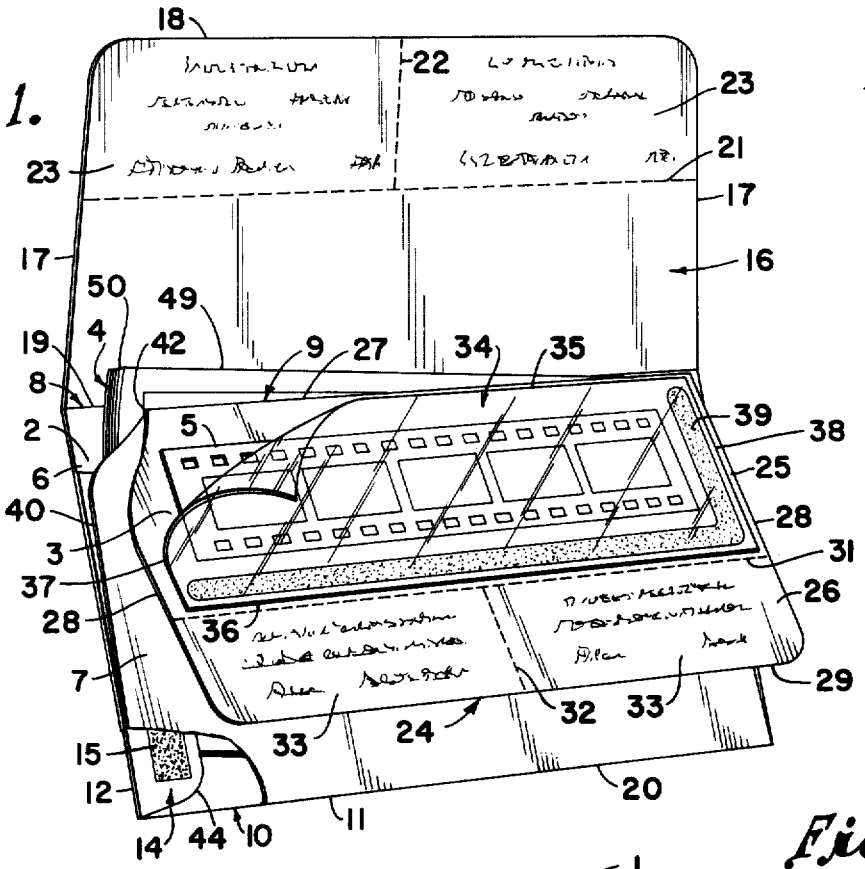
FIG. 1 is a perspective view of a print envelope embodying this invention with a corner portion broken away to reveal interior construction.

Referring more in detail to the drawings:

The reference numeral 1 generally designates an envelope having a main or print pocket 2 and a separate auxiliary or negative pocket 3, respectively adapted for containing photographic prints 4 and negatives 5. Substantially rectangular front panel 6 and back panel 7 overlie each other and respectively have upper edges 8 and 9, lower edges 10 and 11 and opposing side edges 12 and 13. Side flaps 14 are provided for forming the pocket 2 between the front and back panels and, in the illustrated structure, are interconnected along the side edges 12, being folded inwardly between the front and back panels with adhesive connection 15 between a surface of the side flap and a mating, interior surface of the back panel. The pocket 2 has an insert opening defined by front and back panel upper edges 8 and 9.

A substantially rectangular closure flap 16 has side edges 17 and an outer edge 18. The flap 16 is interconnected to the front panel upper edge 8 along a top fold line 19, and covers a major portion of the area defined by the back panel 7 when folded thereover. In the illustrated structure, when the closure flap 16 is in a closed position, the outer edge thereof 18 extends substantially to a bottom fold line 20, and side edges 17 taper slightly inwardly from fold line 19 to the outer edge 18. Perforated tear lines 21 and 22 extend longitudinally and transversely respectively along the closure flap between theside edges 17 and outer edge 18 forming removable coupons 23 having, in this example, printed indicia thereon.

Figure 4:
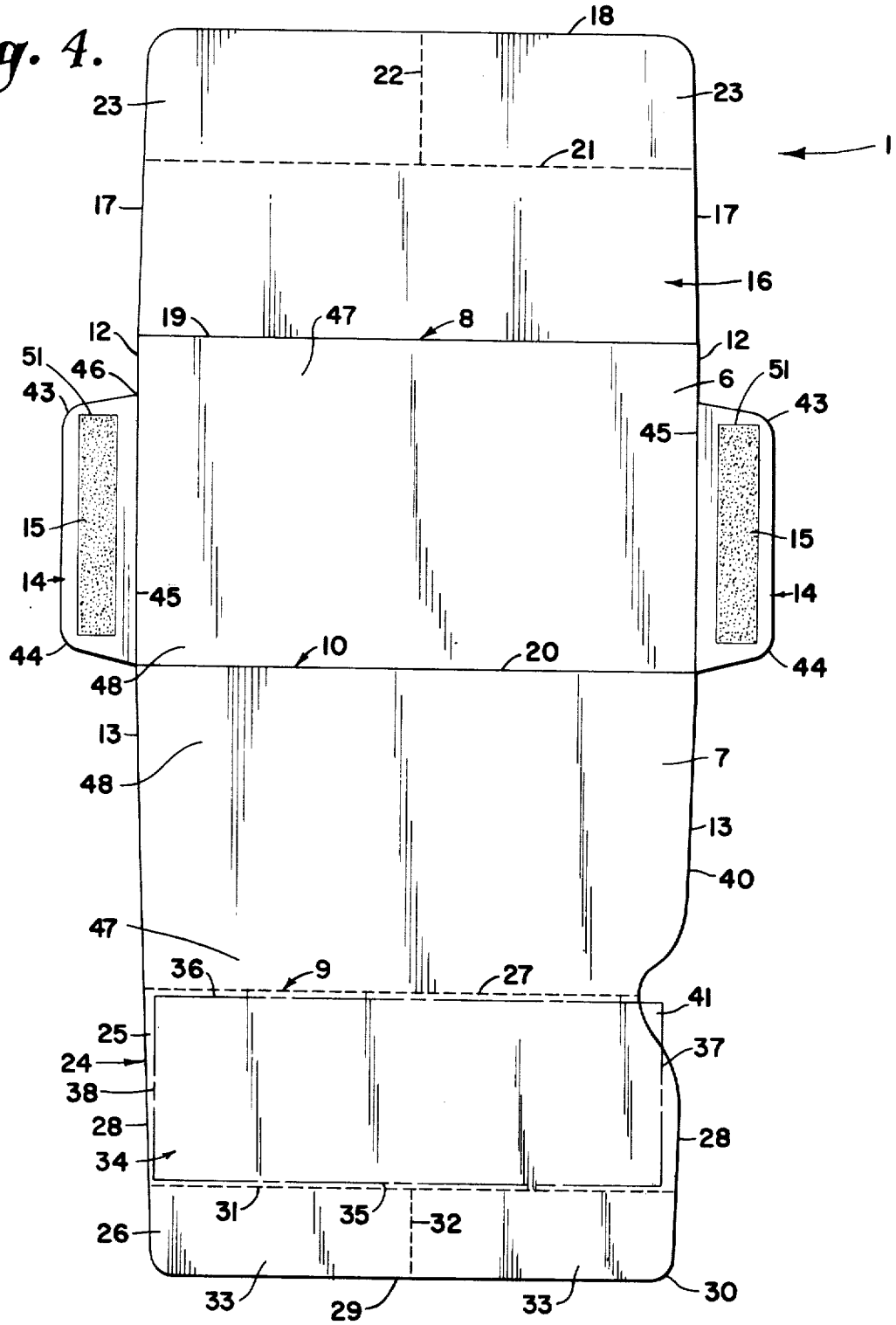
FIG. 4 is a plan view of the blank for producing the envelope, particularly showing the various interconnected envelope panel members.

A substantially rectangular center flap 24, having inner and outer portions 25 and 26, is interconnected to the back panel upper edge 9 along a top fold line 27. The center flap 24 has side edges 28 and an outer or free edge 29 with rounded corners 30. In the illustrated structure, the outer edge 29 terminates a predetermined distance above the bottom fold line 20 and the side edges 28 taper inwardly from the top fold line 27 to the outer edge 29. The center flap outer edge 29 terminates a predetermined distance above closure flap outer edge 18 such that the user can easily raise said closure flap without inadvertently also lifting the center flap. The top fold line 27 is illustrated as being perforated so as to form a tear line for the easy detachment of the center flap 24 and second pocket 3 from the back panel 7. The center flap 24, as illustrated in the drawings, includes a perforated tear line 31 extending substantially parallel to the outer edge 29, and defines the inner and outer portions 25 and 16 of said center flap. A second tear line 32 extends from tear line 31 perpendicularly to outer edge 29 thereby forming, with line 31, removable coupons 33, as shown, with printed indicia thereon. As illustrated in FIG. 4, the front and back panels 6 and 7 and closure, side and center flaps 16, 14 and 24, are constructed of a single blank of sheet material such as conventional envelope paper.

A substantially rectangular patch member 34 having an upper edge 35, a lower edge 36 and side edges 37 is attached to the center flap inner portion 25 along the patch lower edge 36 and one side edge 38 thereof. The center flap inner portion 25 and patch member 34 form said auxiliary pocket 3 having an insert opening between the patch upper edge 35 and the other patch side edge 37, which is particularly well adapted for the storage of photographic negatives therein. In the illustrated structure, the patch member is substantially transparent and may be constructed of glassine type material such as those presently marketed under the trade designations Tricite, Mylar and Dow, such that the contents of the pocket 3 are readily visible. The patch member 34 covers a major portion of the center flap inner portion area 25, and is attached thereto by an adhesive connection 39 which extends along side edge 38 and lower edge 36.

Figure 2:
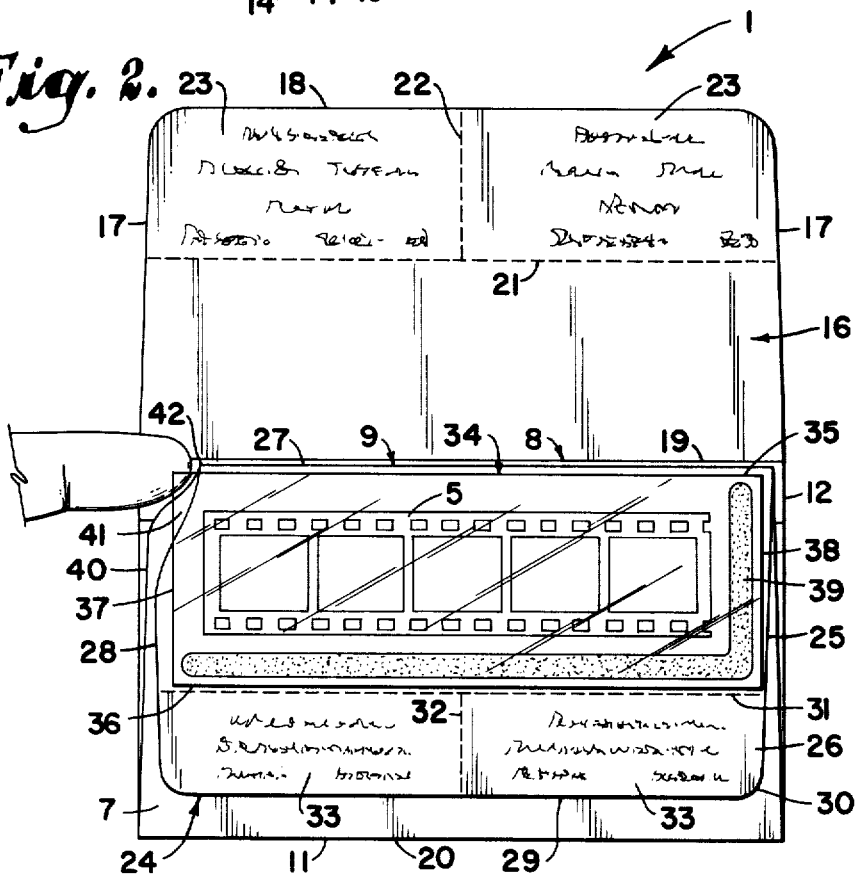
FIG. 2 is a front elevational view of the envelope particularly showing a finger in contact with the negative pocket index tab.
Figure 3:
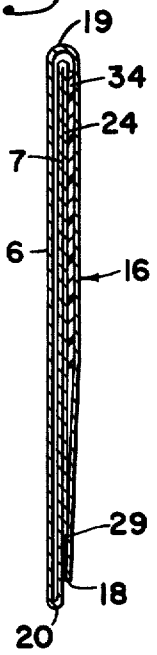
FIG. 3 is a vertical cross-sectional view of the envelope in a closed condition.

As can best be seen in FIG. 4, one side edge 40 of the back panel 7, and the center flap side edge 28 curve inwardly at the top fold line 27, thereby exposing a corner 41 of the patch member 34. As illustrated in FIG. 2, the exposed corner 41 serves as an index tab for easy access to the auxiliary pocket 3. The intersection of the side edges 40 and 28 at fold line 27 defines a corner 42 which protrudes above patch member upper edge 35 when the center flap 24 is folded over patch member 34. The protruding corner 42 facilitates the easy opening of main pocket 2.

The side flaps 14 have upper and lower rounded outer corners 43 and 44 respectively, for presenting a smooth interior to the contents of the main pocket 2. The flaps 14 extend from the front panel lower edge 10 along fold lines 45, but terminate in corners 46 which are spaced from the front panel upper edge 8. The adhesive connection 15 between the side flaps 14 and the back panel 7 is, as illustrated, a substantially linear strip of gum which extends from adjacent the lower outer corners 44 to upper ends 51 spaced from the upper outer corners 43. An imaginary line connecting said gum strip ends divides said front panel 6 and back panel 7 into unattached, upper portions 47 and attached, lower portions 48.

In use, photographic prints may be placed in the normally larger, main pocket 2 by users such as commercial processors of photographic film. The developed negatives are preferably inserted into the normally smaller, auxiliary pocket 3. Although the negatives 5 are readily visible to the customer or photographer for his inspection through transparent patch member 34, they are protected from injuries produced by handling such as finger prints, scratches and the like. Should the user desire to remove the negatives from the auxiliary pocket 3 for purposes such as obtaining additional prints therefrom, his finger can easily engage index tab 41 and withdraw the negatives through the insert opening, by grasping the edges of the negatives, thereby avoiding injurious contact therewith.

The photographic prints 4 can be easily removed from the main pocket 2 by engaging index tab 42 or, by manipulating the center flap 24. With the closure flap 16 in an open position, the user grasps the front panel 6 and center flap 24 of the envelope between the fingers and thumb of one hand. The user's other hand similarly grasps the closure flap 16 between his fingers and thumb. With hands diverging, the user then pulls the center flap 24 slidingly over the back panel 7, causing the upper, unattached portion thereof 47 to roll over or bend curvilinearly away from the front panel 6. As illustrated in FIG. 1, wherein only the left hand corner of the center flap 24 has been so disposed, the uppermost edges 49 and corners 50 of the prints 4 thereby protrude from the main pocket 2. By pinching the fingers and thumb of the user's one hand together, the rolled over position of the back panel 7 can be maintained while the user's other hand releases the closure flap 16 and picks the prints 4 from the main pocket 2.

The coupons 23 and 33 are provided at the outer edges of the closure flap 16 and center flap 24 permitting the user, such as processors of photographic film and/or their retail dealers, to provide advertisements or other consumer incentive devices, in the nature of cents-off coupons, which are readily detachable from the envelope without harmful affects to the utility thereof.

It is to be understood that while certain forms of this invention have been illustrated and described, it is not to be limited to the specific form or arrangement of parts herein described and shown, except insofar as such limitations are included in the following claims.

What I claim and desire to secure by Letters Patent is:

1. A multi-pocket envelope comprising:
   a. substantially rectangular front and back panels interconnected along side and bottom edges thereof forming a first content receiving pocket, said first pocket having an insert opening between the remaining edges of said panels;
   b. a closure flap having a free edge and being connected with said front panel remaining edge along a first fold line;
   c. a center flap having side edges and a free edge and being connected with said back panel remaining edge along a second fold line about which the center flap is folded into overlying relation with at least a portion of the back panel;
   d. a patch member having upper and lower edges and first and second opposing side edges, a portion of said patch member lower edge and a portion of at least one patch member side edge being connected to said center flap forming a second content receiving pocket, said second pocket having an insert opening along at least the patch member upper edge; and
   e. said closure flap being folded into overlying relation with said patch member.

2. An envelope as set forth in claim 1 wherein:
   a. said patch member is transparent such that contents of said pocket are readily visible.

3. An envelope as set forth in claim 1 wherein:
   a. said second fold line is a perforated tear line such that said center panel is easily detachable from said back panel.

4. An envelope as set forth in claim 1 wherein:
   a. inwardly folded side flaps are respectively connected to side edges of one of said panels and terminate in corners spaced from said remaining edges, whereby selected transverse translation of said center flap causes said remaining edges to diverge and expose upper portions of contents of said first pocket.

5. An envelope as set forth in claim 1 wherein:
   a. the center flap and back panel side edges opposite said patch member one side edge curve inwardly at said back panel remaining edge, thereby exposing a tab portion of said patch member for opening said second pocket.

6. An envelope as set forth in claim 1 wherein:
   a. a first perforated tear line extends along said center flap substantially parallel to said center flap free edge, defining substantially rectangular outer and inner center flap areas; and
   b. said patch member is disposed on said center flap inner area with said patch member lower edge substantially parallel to said tear line; said center flap outer area thereby forming a removable coupon adapted to display printed indicia.

7. An envelope as set forth in claim 6 wherein:
   a. at least one perforated tear line extends transversely from said first tear line to said center flap free edge.

8. An envelope as set forth in claim 6 wherein:
   a. at least one perforated tear line extends from said second tear line transversely thereof to said closure flap free edge.

9. An envelope as set forth in claim 1 wherein:
   a. a first perforated tear line extends along said closure flap substantially parallel to said closure flap free edge, defining substantially rectangular outer and inner closure flap areas;
   b. said center flap outer area thereby forming a removable coupon adapted to display indicia.

10. In combination, an envelope and photographic prints and negatives, said envelope comprising:
   a. substantially rectangular front and back panels interconnected along three edges thereof forming a first pocket containing said photographic prints and having an insert opening between the remaining edges of said panels;
   b. a closure flap connected to said front panel remaining edge along a first fold line;
   c. a center flap connected to said back panel remaining edge along a second fold line and onto which the center flap is folded into overlying relation with at least a portion of the back panel;

d. a patch member having upper and lower edges and first and second opposing side edges; a portion of said patch member lower edge and a portion of at least one patch member side edge being connected to said center flap forming a second pocket containing said photographic negatives, said second pocket having an insert opening along the patch member upper edge; and e. said closure flap being folded into overlying relation with said patch member.

11. In combination, an envelope and photographic prints and negatives, said envelope comprising:

a. substantially rectangular front and back panels interconnected along three edges thereof forming a first pocket containing said photographic prints and having an insert opening between the remaining edges of said panels;

b. a closure flap connected to said front panel remaining edge along a first fold line;

c. a center flap connected to said back panel remaining edge along a second fold line and about which the center flap is folded into overlying relation with at least a portion of the back panel;

d. a patch member having upper and lower edges and first and second opposing side edges; at least one of said patch member edges being connected to said center flap forming a second pocket containing said photographic negatives, said second pocket having an insert opening at least along one of said patch member edges; and e. said closure flap being folded into overlying relation with said patch member.

* * * * *